United States Patent [19]

Raupach

[11] 3,953,815

[45] Apr. 27, 1976

[54] CAST-RESIN INSULATED INSTRUMENT TRANSFORMER, IN PARTICULAR POTENTIAL TRANSFORMER

[76] Inventor: Friedrich Raupach, Wildensorger Strasse 9, D-8600 Bamberg, Germany

[22] Filed: Nov. 7, 1974

[21] Appl. No.: 521,713

[30] Foreign Application Priority Data

Nov. 15, 1973 Germany ..... 2356988

[52] U.S. Cl. ..... 336/90; 174/18; 336/94; 336/96; 336/107

[51] Int. Cl.[2] ..... H01F 27/02

[58] Field of Search ..... 336/90, 92, 94, 96, 336/107; 174/18, 16 BH, 15 BH, 14 BH, 12 BH

[56] References Cited

UNITED STATES PATENTS

| | | | |
|---|---|---|---|
| 1,459,988 | 6/1923 | Pressey | 336/90 |
| 1,574,064 | 2/1926 | Chamberlain | 336/107 |
| 1,706,140 | 3/1929 | Brand | 174/18 X |
| 1,768,522 | 6/1930 | Brown | 174/18 |
| 1,932,456 | 10/1933 | Gaston | 336/107 X |
| 2,396,871 | 3/1946 | Meyerhans | 174/18 |
| 2,647,939 | 8/1953 | Paluev | 174/18 |
| 2,962,541 | 11/1960 | Snader | 174/18 |
| 3,621,426 | 11/1971 | Bennon | 336/90 |
| 3,674,696 | 7/1972 | Griffiths | 336/94 X |
| 3,774,135 | 11/1973 | Kashima | 336/94 X |

FOREIGN PATENTS OR APPLICATIONS

| | | | |
|---|---|---|---|
| 1,156,135 | 10/1963 | Germany | 174/18 |
| 1,807,997 | 5/1970 | Germany | 336/96 |

*Primary Examiner*—Thomas J. Kozma
*Attorney, Agent, or Firm*—H. J. Rathbun

[57] ABSTRACT

The transformer, in particular a potential transformer, comprises a generally planar bushing insulator, dimensioned for a liquid or gaseous insulating medium and coaxially enclosing a high-voltage connector, and a flange section enclosing the bushing insulator. The bushing insulator is also enclosed by an intermediate flange filled with a liquid or gaseous insulating medium. One end of the intermediate flange is connected to the instrument transformer and the other end of the intermediate flange is connected to a self-contained high-voltage bushing. A high-voltage connector of the transformer is connected to a conductor of the high-voltage bushing in the space enclosed by the intermediate flange.

7 Claims, 1 Drawing Figure

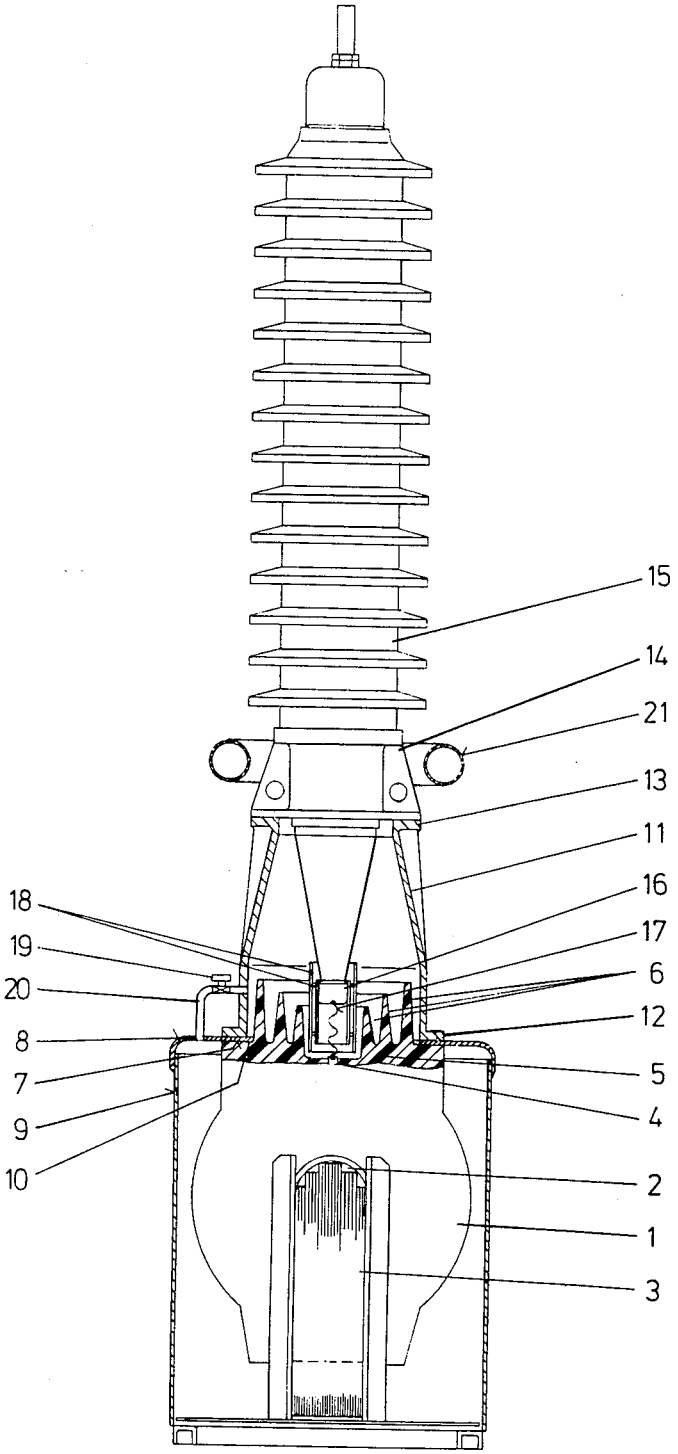
15
14
21
13
11
16
17
6
12
5
4
2
1
3
18
19
20
8
7
9
10

CAST-RESIN INSULATED INSTRUMENT TRANSFORMER, IN PARTICULAR POTENTIAL TRANSFORMER

Magnetic instrument transformers for high and extra high voltages are normally manufactured such that the capacitively graded insulation of the windings is both machine and hand-made in one piece, partly by taping (wrapping) and partly by epoxy-resin casting.

To attain a more rational production, it has already become known for high-voltage current transformers to make the core-winding-insulation unit and the high-voltage lead separately and to join these parts only subsequently using special insulating materials. In this, different types of insulation having different specific dielectric strength may be used for the individual sections German applications (DT-AS 1 563 272 and 1 803 633) published on July 2, 1970 and Apr. 23, 1970 respectively.

Further, in order to reduce the processing times and thus the manufacturing cost, a magnetic instrument transformer has become known, the active parts of which are housed in a tank filled with a liquid or gaseous insulating medium. The bushing of this instrument transformer is made of solid material. It is a self-contained component which is connected with the tank. The bushing conductor is connected within the tank to the active system of the transformer German application (DT - OS 2 115 113) published on Sept. 28, 1972.

Last but not least a potential transformer has become known which is used for gas-insulated metal-clad high-voltage switchgear (GIS). The windings and core of this potential transformer are arranged in a gas-filled pressure tank, which can be flanged gas-tight to the metal encapsulation. The cast-resin insulating body, which is enclosing the windings completely, has a peripheral flange in the region of where it encircles the high-voltage lead. By means of this flange, the insulating body is fitted to a mounting plate, which has an aperture for the bushing insulator of the transformer and for the high-voltage lead.

The invention concerns a cast-resin insulated instrument transformer, in particular a potential transformer, having firstly a generally planar and circular bushing insulator dimensioned for a liquid or gaseous insulating medium and coaxially enclosing the high-voltage connector, and secondly a flange section enclosing the bushing insulator.

It is the aim of the present invention to provide such an instrument transformer which can be connected not only to a GIS but also to a conventional switchgear, taking advantage of its compact design, in particular its extremely short bushing insulator which is dimensioned for a liquid or gaseous insulating medium.

The present invention solves the above problem by providing a bushing insulator which is enclosed by an intermediate flange filled with a liquid or gaseous insulating medium, one end of this intermediate flange being connected to the instrument transformer, the other end of this intermediate flange being connected to a self-contained high-voltage bushing, and the high-voltage connector of the instrument transformer being connected to the conductor of the high-voltage bushing in the space enclosed by the intermediate flange.

In using the cast-resin insulated instrument transformer according to the invention both for GIS and for conventional switchgear without any constructional changes of the active parts, its insulating shell or its tank, the transformer can be manufactured in large quantities resulting in economy of price.

The bushing which is required for service in a conventional switchgear can be made and tested separately as a self-contained component or it can be purchased from a bushing manufacturer and be mounted on the separately manufactured and tested transformer. This helps to reduce the processing times and to gain savings in manufacturing cost. Moreover, any faults which might be detected in testing can be located and remedied more quickly than with conventional design instrument transformers. Due to the compact design of the transformer and to the very short height of the bushing insulator, the weight of the resin casting is relatively low. This does away with the problems in manufacturing large castings, for instance the formation of voids or cracks.

Further details and advantages of the invention are given on the attached drawing of a transformer which is manufactured according to the invention.

The drawing shows in a cross-sectional partial view a potential transformer housed in a gas-tight tank.

The high-voltage and low-voltage windings (not shown in the drawing) of the potential transformer designed for GIS are embedded in a cast-resin body 1 having sufficient insulation to withstand the proposed tests.

The cast-resin body 1 has a center hole 2, into which a stacked core 3 will be inserted subsequently. The secondary leads are fed into a terminal box (not shown in the drawing). The high-voltage connector 4 is encircled by a generally planar and circular cast-resin bushing insulator 5, the strike and creepage distances of which are dimensioned for a liquid or gaseous insulating medium. To increase the creepage distance, the bushing insulator 5 has coaxially arranged grooves or sheds 6, the extension of which increases in the direction from the high-voltage connector to the flange.

By means of a flange section 7, the potential transformer is fixed to the tank cover 8 of a gas- or oil-tight tank 9. The cover 8 of the tank 9 has an aperture 10 for the oil- or gas-tight passage of the bushing insulator 5 of the transformer. The tank 9 is filled with inert or electro-negative gas, for instance nitrogen or sulphur hexafluoride ($SF_6$), preferably at increased pressure, to protect the stacked core 3 against corrosion.

An intermediate flange 11 made from an aluminium-magnesium-silicon-alloy or any other gas-tight or oil-tight antimagnetic material is mounted on the tank 9. The lower end 12 of the intermediate flange 11 is connected to the cover 8, and its upper end 13 is connected to the connection flange 14 of a self-contained outdoor bushing 15. These connections are gas- or oil-tight. The volume enclosed by the intermediate flange 11 is filled with a liquid insulating medium, for instance insulating oil with or without filler (quartz powder) or with a gaseous insulating medium, for instance nitrogen or $SF_6$. The outdoor bushing 15 may be of the known oil-impregnated condenser bushing type. The volume between the capacitor stack and the porcelain shell may be filled, instead of with oil, with gas or a compound. The end of the condenser bushing 15 to be connected to the potential transformer is of conical shape and terminated by a terminating shield 16 of the central bushing conductor or tube (not shown in the drawing). The terminating shield 16 is connected to the high-voltage connector 4 of the potential transformer by means of a flexible lead 17. To center the lead 17 in the bushing insulator 5, coaxial guide sleeves 18 are connected with the terminating shield 16.

In case the same insulating medium or corrosion protective (oil or $SF_6$) is used in both the tank 9 and intermediate flange 11, these two chambers can be interconnected by means of a duct 20, which is to be provided with a blocking valve 19. In this case, one expansion chamber will suffice for the two vessels. This expansion chamber may be a conventional annular tube 21 around the connection flange 14. The tube 21 may be connected with the oil chamber (enclosed by the intermediate flange 11) by means of a metal flexible tube. It goes without saying that other expansion systems, for intance bellows or a nitrogen cushion, may be provided.

The porcelain insulator of the bushing may be provided with sheds if the transformer will be for outdoor use or without sheds if the transformer will be for indoor use.

The connection between the high-voltage connector 4 and the conductor of the bushing or its terminating shield 16 may be a plug-and-socket coupling to ease assembly.

In the drawing, the cast-resin insulated instrument transformer is enclosed by a tank which is filled with inert or electro-negative gas to protect the uncovered stacked core against corrosion. Of course, the core of the transformer may be completely embedded in the epoxy resin in one casting process. In that case, special protection against corrosion is not a necessity so that no tank or cover are required. With this design, the cast-resin flange of the transformer can be directly connected to the intermediate flange. Suitable sockets for mounting can be provided in the cast-resin flange.

The invention explained above with regard to a potential transformer can be employed with equal or similar advantages on current transformers, preferably of the known tank-type construction.

The invention can be used on instrument transformers of any voltage level. An upper limit of the voltage level is given only by the increasing casting volume of the cast-resin transformer, which is preferably a single-stage unit. For very high voltages, the cast-resin insulated transformer may also be of the cascade-style.

A particular advantage of the cast-resin insulated transformer according to the invention is that it can be used in conventional switchgear also at extremely high voltage levels for which hitherto only oil-insulated transformers had been preferred. Apart from the solid insulation of the actual transformer, only a small amount of a liquid or gaseous insulating medium in the intermediate flange is required in the transformer portion separated from the high-voltage bushing insulator by its connection flange.

The invention claimed is:

1. In a compact cast-resin insulated instrument transformer having a cast-resin body and a high-voltage connector extending out of the body, the improvement comprising:

a generally planar cast-resin bushing insulator connected directly to said body and coaxially encircling said high-voltage connector, said insulator having a plurality of coaxially arranged sheds extending upwardly therefrom to increase creepage distance, said sheds respectively increasing in height in a direction radially outwardly from said high-voltage connector, a pair of coaxial guide sleeves disposed radially inwardly of said sheds, and a cast-resin flange section surrounding the periphery of said bushing insulator;

a high-voltage bushing having a conductor extending therethrough, and one end thereof dimensioned to be insertable within said guide sleeves for aligning the same on said bushing insulator immediately adjacent to said high-voltage connector;

means for connecting the conductor of said high-voltage bushing to said high-voltage connector; and an intermediate flange defining a fluid-tight enclosure to be filled with a fluid insulating medium, one end of said intermediate flange being connected to said cast-resin body and enclosing said sheds, the other end of said intermediate flange being connected to said high-voltage bushing thereby enclosing said connection between said shield and said high-voltage connector within said fluid insulating medium of said intermediate flange enclosure.

2. An instrument transformer according to claim 1, wherein said connection between said high-voltage connector and said conductor of the high-voltage bushing is detachable.

3. An instrument transformer according to claim 1, including a fluid-tight tank having a cover thereon with an opening therethrough, said cast-resin body of said transformer being disposed within said tank, said bushing insulator being connected to the cover of said tank around said cast-resin flange section, the coaxial sheds of said bushing insulator extending through the opening of the tank cover a predetermined height thereabove.

4. An instrument transformer according to claim 3, including a connecting duct to connect the interior of said tank with the interior of said intermediate flange enclosure, and a fluid-tight blocking valve connected to said duct for opening and closing the same to control fluid flow.

5. An instrument transformer according to claim 1, wherein said cast-resin body and bushing insulator including its sheds and flange section are integrally formed from a single epoxy resin casting.

6. A compact cast-resin insulated instrument transformer including a core, high and low voltage windings and a high-voltage connector, comprising:

a cast-resin body embedding the core, windings and connector extending upwardly therefrom;

a cast-resin bushing insulator integrally formed with said body and encircling the connector, said integrally formed insulator including a generally planar surface, a plurality of coaxial sheds integrally formed with the planar surface and projecting upwardly therefrom, and a flange section integrally formed with said insulator and extending around the periphery thereof;

a high-voltage bushing having one end disposed radially inwardly of said sheds and immediately adjacent the connector for a detachable connection thereto; and an intermediate flange encircling said high-voltage bushing and the sheds, said intermediate flange defining a fluid-tight enclosure therearound to be filled with a fluid insulating medium, and having one end connected to said high-voltage bushing and the other end directly connected to the flange section of said insulator to provide a compact transformer design of less weight than tank enclosed designs.

7. The insulated instrument transformer of claim 6 wherein said body around the windings defines a generally bulbous configuration having a cylindrical neck portion extending upwardly to the planar surface of said bushing insulator whereby planar surface of said bushing insulator is approximately tangent to the circumference of said bulbous configuration to provide the compact design of the transformer.

* * * * *